US008770832B1

(12) United States Patent
Kuo

(10) Patent No.: US 8,770,832 B1
(45) Date of Patent: Jul. 8, 2014

(54) FLIP WATCH BEZEL

(71) Applicant: Howard Kuo, Atlanta, GA (US)

(72) Inventor: Howard Kuo, Atlanta, GA (US)

( * ) Notice: Subject to any disclaimer, the term of this patent is extended or adjusted under 35 U.S.C. 154(b) by 0 days.

(21) Appl. No.: 13/749,400

(22) Filed: Jan. 24, 2013

(51) Int. Cl.

| | |
|---|---|
| ***G04B 39/00*** | (2006.01) |
| ***G04B 19/22*** | (2006.01) |
| ***G04B 25/00*** | (2006.01) |
| ***G04C 17/00*** | (2006.01) |
| ***G04B 37/00*** | (2006.01) |
| ***G04B 19/28*** | (2006.01) |

(52) U.S. Cl.
CPC ..... *G04B 19/283* (2013.01)
USPC ..... 368/295; 368/21; 368/223

(58) Field of Classification Search
USPC ..... 368/294, 295, 223, 232, 233, 15–17
See application file for complete search history.

(56) References Cited

U.S. PATENT DOCUMENTS

| | | | | |
|---|---|---|---|---|
| 4,368,578 | A * | 1/1983 | Carroll et al. | 434/140 |
| 4,941,137 | A * | 7/1990 | Kikuchi | 368/223 |
| 5,253,225 | A * | 10/1993 | Vaucher | 368/20 |
| D399,447 | S | 10/1998 | Pandel | |
| 6,262,947 | B1 * | 7/2001 | Pulver | 368/223 |
| 6,379,037 | B1 * | 4/2002 | Saleh et al. | 368/185 |
| 6,944,098 | B2 * | 9/2005 | Rochat et al. | 368/88 |
| D576,906 | S | 9/2008 | Calvani | |
| 7,901,129 | B2 | 3/2011 | Bertrand et al. | |
| 7,988,350 | B2 | 8/2011 | Bonnet et al. | |
| 8,040,759 | B2 * | 10/2011 | Chaignat | 368/38 |
| 8,052,323 | B2 | 11/2011 | Takeda | |
| D651,929 | S | 1/2012 | Bertucci | |
| D652,326 | S | 1/2012 | Kummer | |
| 2008/0279053 | A1 * | 11/2008 | Robert-Nicoud et al. | 368/295 |

* cited by examiner

*Primary Examiner* — Amy Cohen Johnson
*Assistant Examiner* — Daniel Wicklund
(74) *Attorney, Agent, or Firm* — Sean P. O'Hanlon, Esq., PLLC

(57) ABSTRACT

A watch with an adjustable bezel is disclosed and claimed. The adjustable bezel is an assembly including a lower bezel plate that attaches to the watch face and an upper bezel plate that is adjustable attached to the lower bezel plate. The upper bezel plate is connected to the lower bezel plate such that it is moveable to be positioned atop either half of the lower bezel plate. The exposed surfaces of the upper and lower bezel plates contain indicia that cooperate to form a complete set that extends around the perimeter of the watch. By moving the upper bezel plate to the opposite side of the lower bezel plate, different surfaces of the bezel plates are exposed. These different surfaces contain a second set of cooperating indicia that is different from the first set. Thus, the present invention allows the user to easily adjust the multiple viewable indicia on the watch.

14 Claims, 12 Drawing Sheets

FLIP WATCH BEZEL

BACKGROUND OF THE INVENTION

1. Field of the Invention

The present invention relates to a watch such as a wristwatch or a pocket watch equipped with a bezel, and more particularly to a watch with an adjustable bezel.

2. Description of the Related Art

Most watches contain a bezel. The bezel is of a ring-like configuration and is mounted to the outer periphery of the upper portion of a watch case so as to be rotatable or otherwise maneuvered about the watch case. A bezel can be arranged and set by the user so as to allow for readings related to the time and other time keeping and watch functions. Examples of bezel usages in this application can be dual time, elapsed time, tachymeter, GMT, and other functions.

The prior art technique of the bezel typically is a set disc that is affixed and possibly adjustable circumferentially around the watch face. Due to the mechanics of the mounting, the prior art technique is that only the outer (that is, upper) face of the bezel is shown. The printed readings on this bezel face only allow for restricted usage due to the limited printed readings available to be seen. To gain further usage of the bezel, such as another bezel usage listed above, one would have to either replace the bezel or use another watch with the desired bezel usage.

SUMMARY OF THE INVENTION

The present invention relates to a watch such as a wristwatch or a pocket watch equipped with a bezel, and more particularly to a watch with an adjustable bezel. The adjustable bezel is an assembly including a lower bezel plate that attaches to the watch face. An upper bezel plate is rotatively attached to the lower bezel plate, preferably along an axis of symmetry dividing the lower bezel plate. Hinges may be provided to connect the upper and lower bezel plates while allowing the upper bezel plate to rotate to be positioned atop either half of the lower bezel plate as defined by the axis of symmetry. One or more detents are provided to releasably retain the upper bezel plate in its use positions.

The lower bezel plate has a surface upon which indicia may be provided. The surface is opposite the watch face, such that it can be viewed by the user when the bezel assembly is connected to the watch. Two sets of indicia are provided on the lower bezel plate surface, the sets being positioned on opposite sides of the axis. By rotating the upper bezel plate from one extreme position to the other, one set of lower bezel plate indicia is blocked from view while the other set is viewable. The upper bezel plate contains opposing surfaces upon which two additional sets of indicia are provided. Again, rotating the upper bezel plate between its extreme positions reveals one set of indicia while blocking the other set from view. The upper bezel plate has a shape that matches one-half of the lower bezel plate. Thus, in its use positions the upper bezel plate overlies and blocks half of the lower bezel plate, blocking the indicia on that portion of the lower bezel plate as well as the unexposed surface of the upper bezel plate.

The sets of indicia on the upper and lower bezel plates that are exposed with the upper bezel plate in either of its use positions cooperate to form a complete set of indicia that extends around the entire perimeter of the watch face. The specific indicia used can vary per the user's desire, and preferably the sets of indicia are varied. One possible variation could be one set of indicia containing Arabic numbers and the other set of indicia containing Roman numbers. Another possible variation could be one set of indicia containing a tachymeter and the other set of indicia depicting time information for a second time zone. Of course, other indicia variations are possible. Thus, the present invention allows the user to easily adjust the viewable indicia on the watch.

DESCRIPTION OF THE DRAWINGS

The present invention is described with reference to the accompanying drawings, which illustrate exemplary embodiments and in which like reference characters reference like elements. It is intended that the embodiments and figures disclosed herein are to be considered illustrative rather than restrictive.

DETAILED DESCRIPTION OF THE INVENTION

Figure 1:
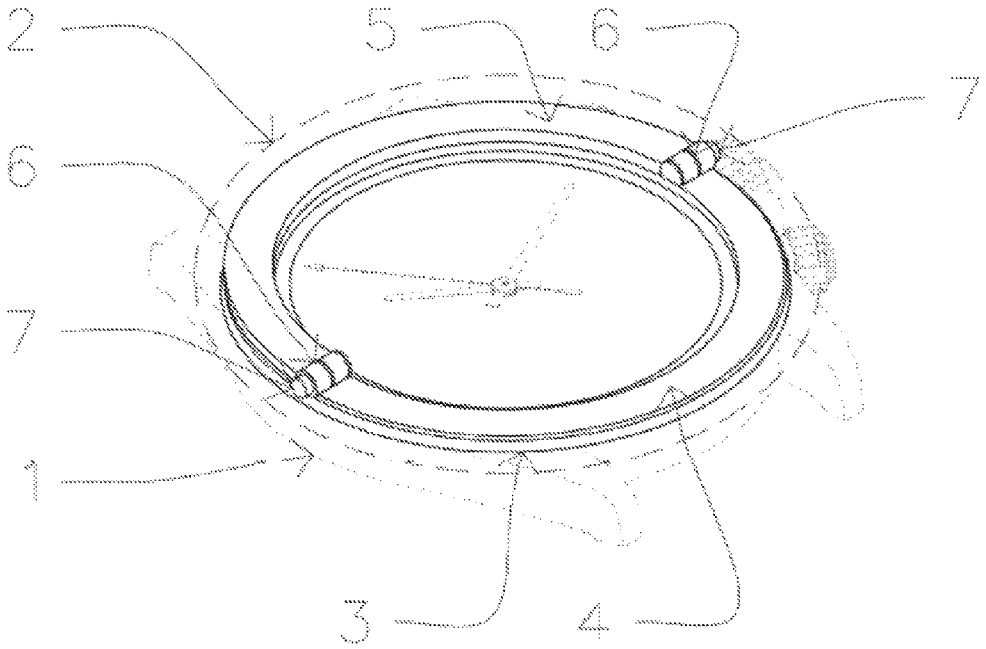
FIG. 1 is a perspective view of a flip watch bezel of the present invention in a first use position.

In the following, the invention will be described in detail with reference to FIGS. 1 through 10. FIG. 1 shows a perspective view of a flip watch bezel of the present invention in a first use position. In the illustrative view of FIG. 1, a watch case 1 shows context of the bezel location and mounting. The case 1 is not critical to the invention; the inventive bezel can be used with virtually any watch case. For illustrative purposes, a circular case and bezel are illustrated, but the present invention may be applied to any watch, and is especially applicable to symmetrically shaped watches or watches with symmetrically shaped faces. The bezel assembly 2 is comprised of several elements. The bezel assembly 2 is affixed to the watch case at interface 3 via standard mounting methods, which may include mechanical fasteners and/or adhesives. This may or may not allow for rotation or adjustments depending on the design. The bezel assembly 2 includes a lower bezel plate 4 that is the primary area for printed readings. For the first usage position of the bezel 2, the printed readings will be on half of the lower bezel plate 4 as well as a first surface of an upper bezel plate 5. Pivot hinges 6 allow for the adjustment or flipping of the upper bezel plate 5 at the user's discretion via a spring-biased detent release 7, which retains the upper bezel plate 5 in the use positions. The detent 7 may include notch and groove features that prevent movement of the upper bezel plate 5 until the detent 7 is engaged by the user. Once the upper bezel plate 5 is rotated to a position of use, the spring biases the notch back into contact within the groove, preventing further movement of the upper bezel plate 5 until the user again engages the detent 7.

It should be noted that in addition to being printed on the bezel plates 4, 5, other methods of presenting the indicia, such as etching, inscribing, or other methods, can be used.

Figure 2:
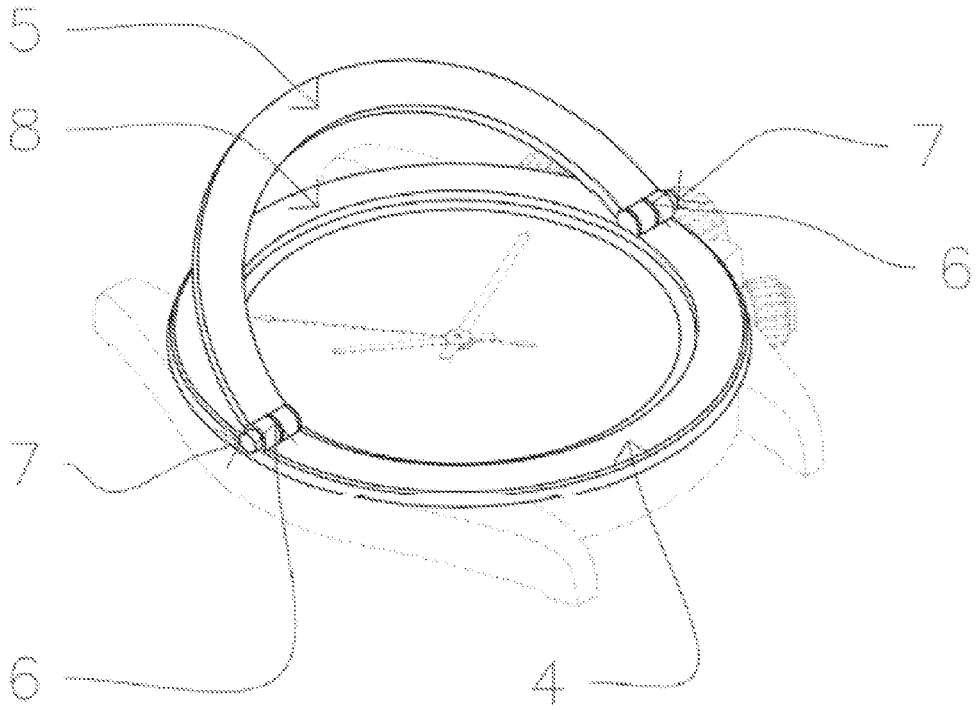
FIG. 2 is a perspective view of the flip watch bezel of FIG. 1, showing the bezel at a transition point between the first use position of FIG. 1 and a second use position.

In FIG. 2, once the spring-biased detent release 7 has been depressed, the upper bezel plate 5 is released and may be moved into its secondary usage position. In FIG. 2, the upper bezel plate 5 is shown in a transition point between the first and second use positions. The spring-biased detent release 7 will have a corresponding locking mechanism to set and retain the upper bezel plate 5 in either use position without movement. FIG. 2 shows the upper bezel plate 5 in transit towards the second use position. A secondary set of printed readings begins to reveal itself on the previously covered lower bezel plate 8, which is contiguous with the lower bezel plate 4.

Figure 3:
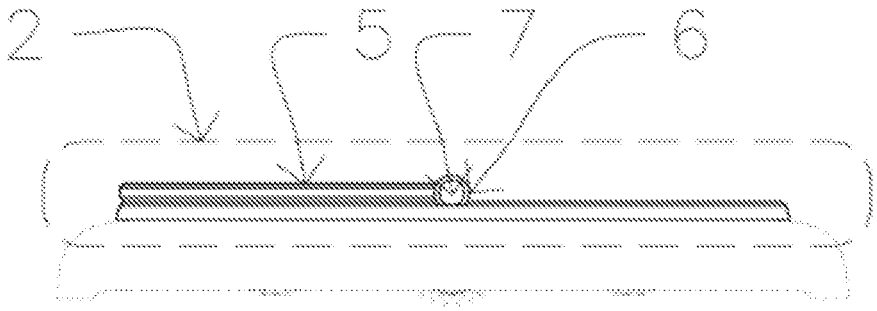
FIG. 3 is a side view of the flip watch bezel of FIG. 1, showing the bezel in a first use position.
Figure 4:
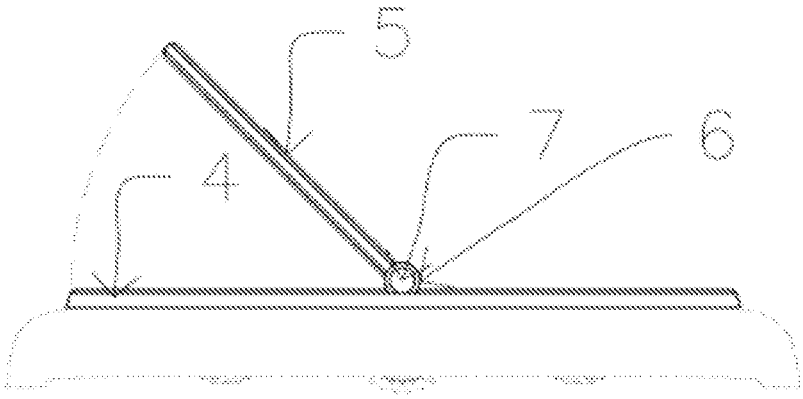
FIG. 4 is a side view of the flip watch bezel of FIG. 1, showing the bezel in a first state of transition between a first use position and a second use position.
Figure 5:
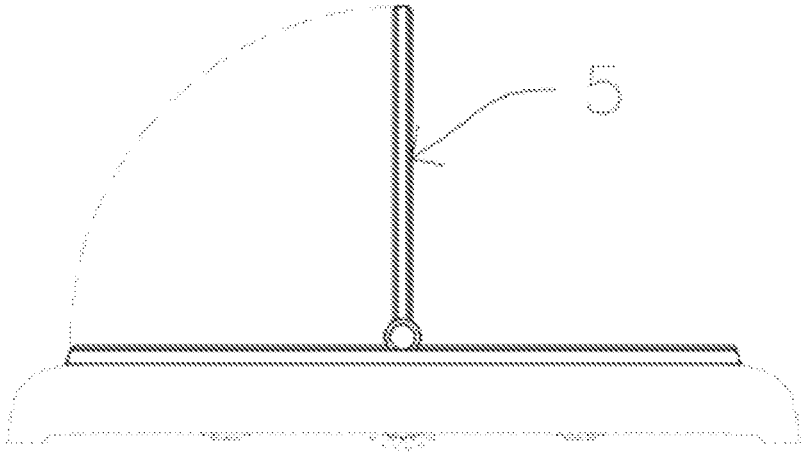
FIG. 5 is a side view of the flip watch bezel of FIG. 1, showing the bezel in a second state of transition between a first use position and a second use position.
Figure 6:
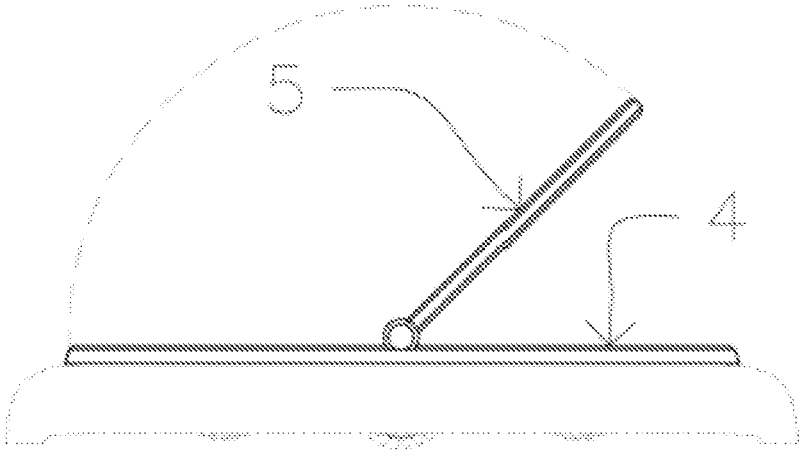
FIG. 6 is a side view of the flip watch bezel of FIG. 1, showing the bezel in a third state of transition between a first use position and a second use position.

FIGS. 3 and 4 illustrate a side view of the bezel assembly 2. FIG. 3 illustrates a side view of the bezel assembly 2 showing the entire assembly in the first locked position. The upper bezel plate 5 is locked in place via the pivot 6 and spring-biased detent release 7. FIG. 4 illustrates a side view of the bezel assembly 2 in a transition position between usage positions. The spring-biased detent release 7 has been enabled, freeing the upper bezel plate 5 to rotate via the pivot 6 away from one side of the lower bezel plate 4. In FIG. 5, the upper bezel plate 5 is halfway between the first and second usage positions. In FIG. 6, the upper bezel plate 5 is almost at its second usage position on the opposite side of the lower bezel plate 4 from the first use position.

Figure 7:
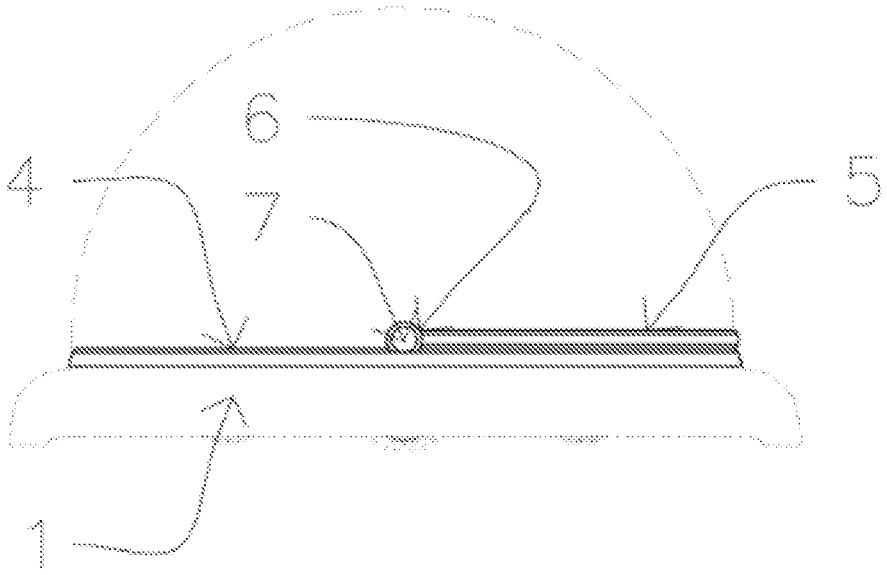
FIG. 7 is a side view of the flip watch bezel of FIG. 1, showing the bezel in a second use position.

In FIG. 7, the upper bezel plate 5 is locked into the second usage position via the pivot 6 and spring-biased detent release 7. In this second usage position, the printed readings on the opposite surface of the upper bezel plate 5 and the previously covered side of the lower bezel plate 4 are revealed to allow for the second usage printed readings. The upper bezel plate 5 and corresponding elements mechanically work independently of the lower bezel plate 4, which remains constantly attached to the watch case 1.

Figure 11:
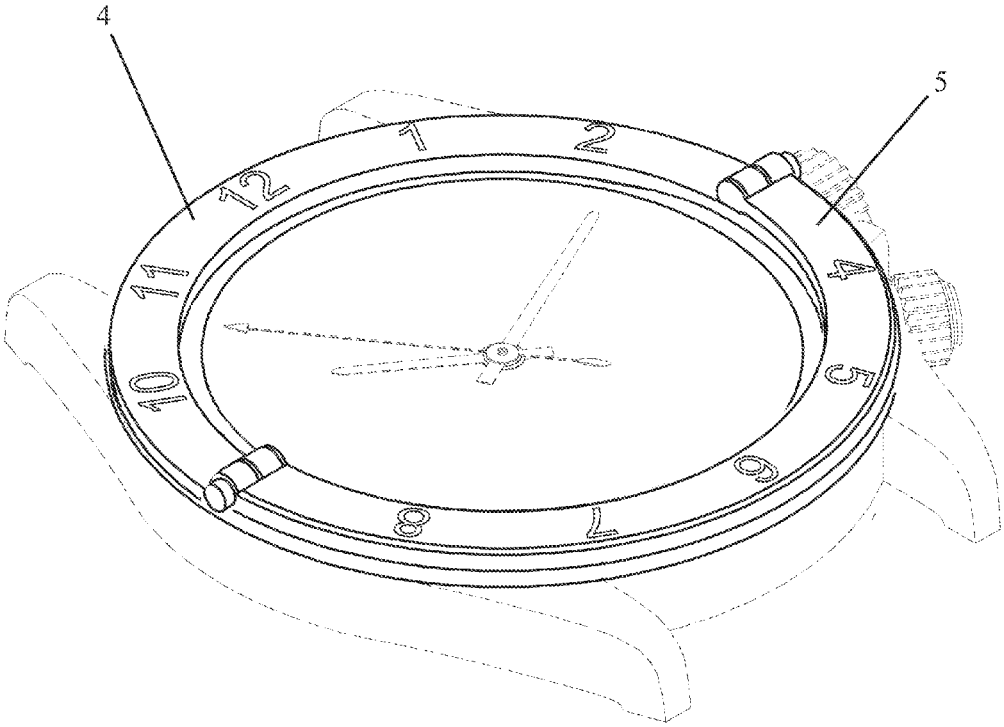
FIG. 11 shows a perspective view of the flip watch bezel of FIG. 1 in a first use position and illustrates a first set of indicia.
Figure 12:
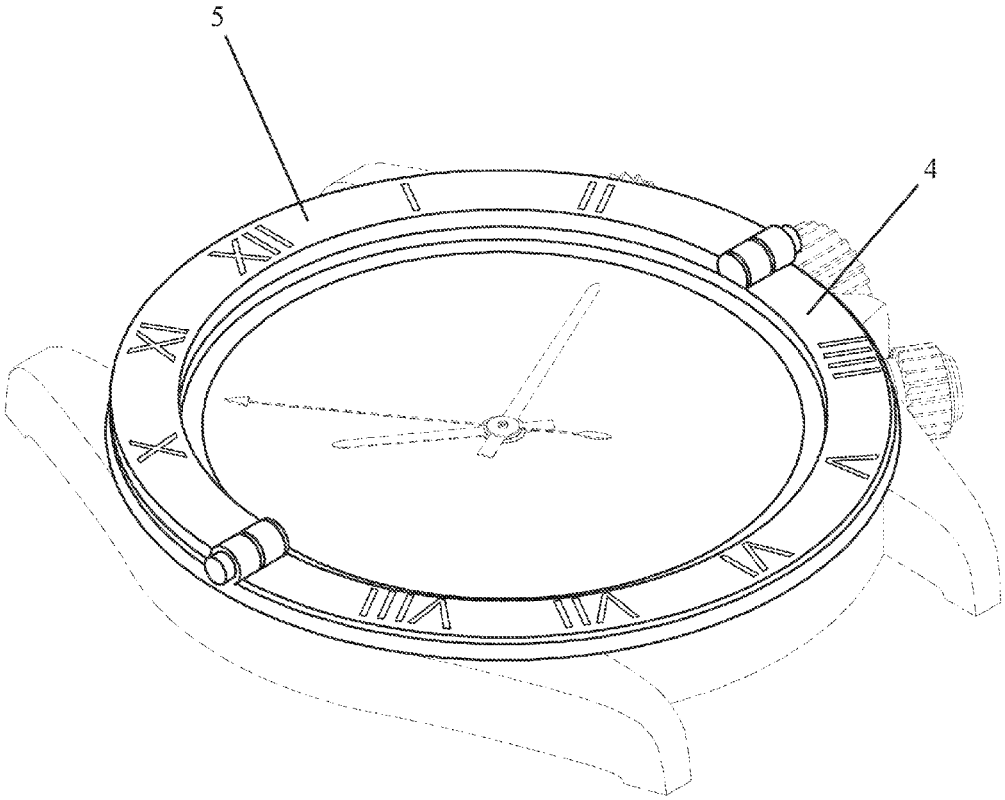
FIG. 12 shows a perspective view of the flip watch bezel of FIG. 1 in a second use position and illustrates a second set of indicia.

The sets of indicia on the upper and lower bezel plates 5, 4 that are exposed with the upper bezel plate 5 in either of its use positions cooperate to form a complete set of indicia that extends around the entire perimeter of the watch face. The specific indicia used can vary per the user's desire, and preferably the sets of indicia are varied. One possible variation could be one set of indicia containing Arabic numbers as illustrated in FIG. 11 and the other set of indicia containing Roman numbers as illustrated in FIG. 12. Another variation may include providing one cooperating set of upper and lower bezel indicia that is blank, allowing the user to present a watch without bezel markings. Another variation could be one set of indicia containing a tachymeter and the other set of indicia depicting time information for a second time zone. These possible indicia variations are merely illustrative; other indicia variations could be used. Thus, the present invention allows the user to easily adjust the viewable indicia on the watch.

Figure 8:
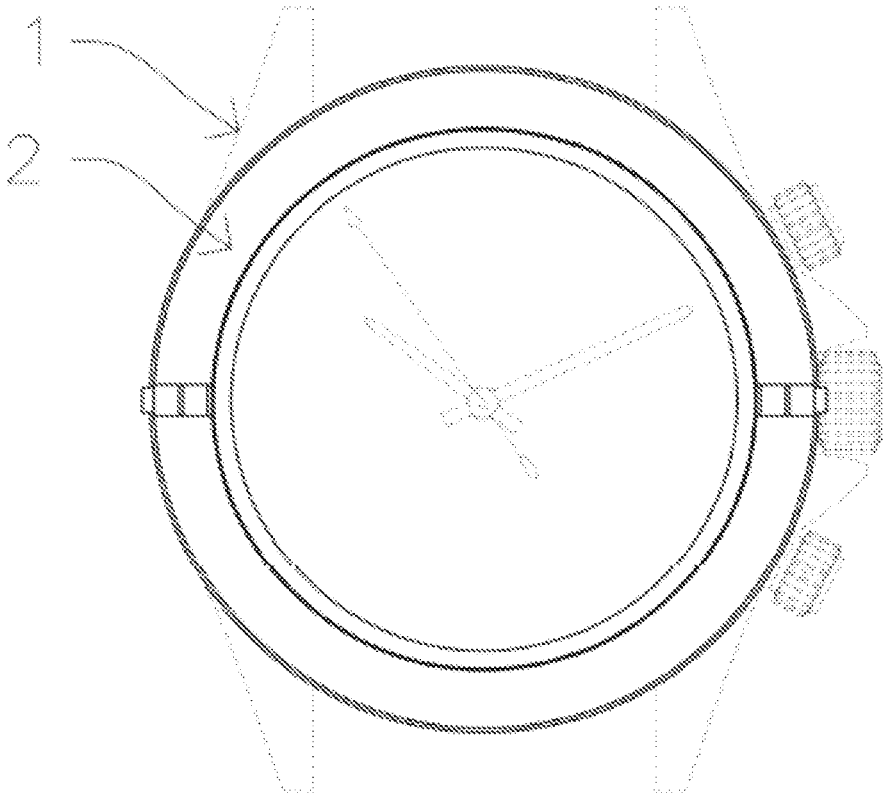
FIG. 8 is a top view of the watch bezel of FIG. 1, showing the bezel in a first use position.
Figure 9:
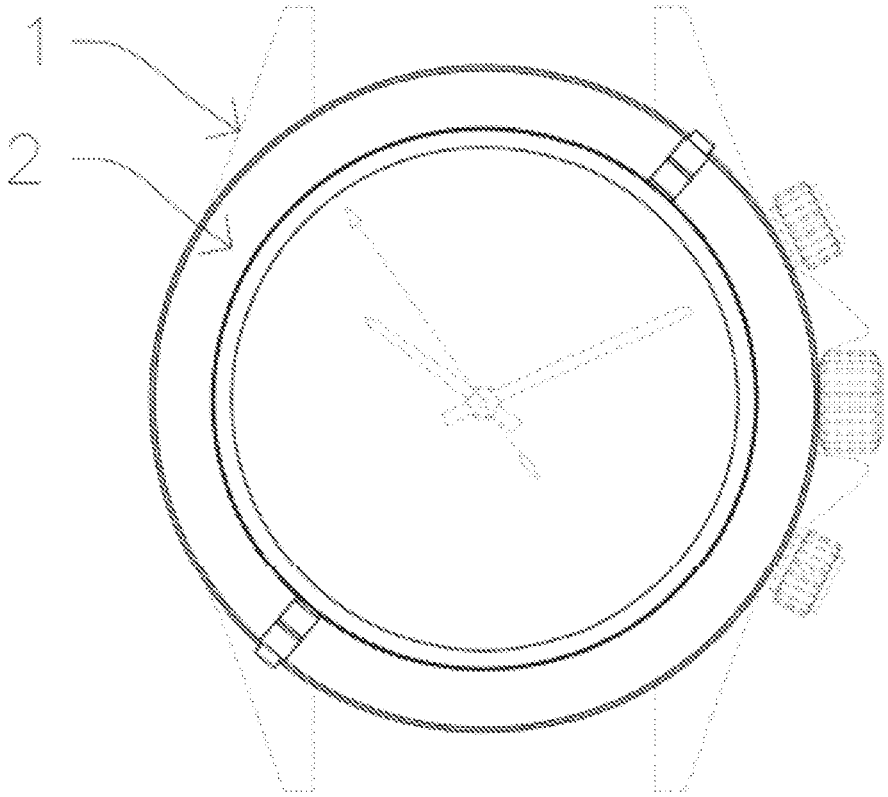
FIG. 9 is a top view of the watch bezel of FIG. 1, showing the bezel in a second use position rotated from the first position of FIG. 8.
Figure 10:
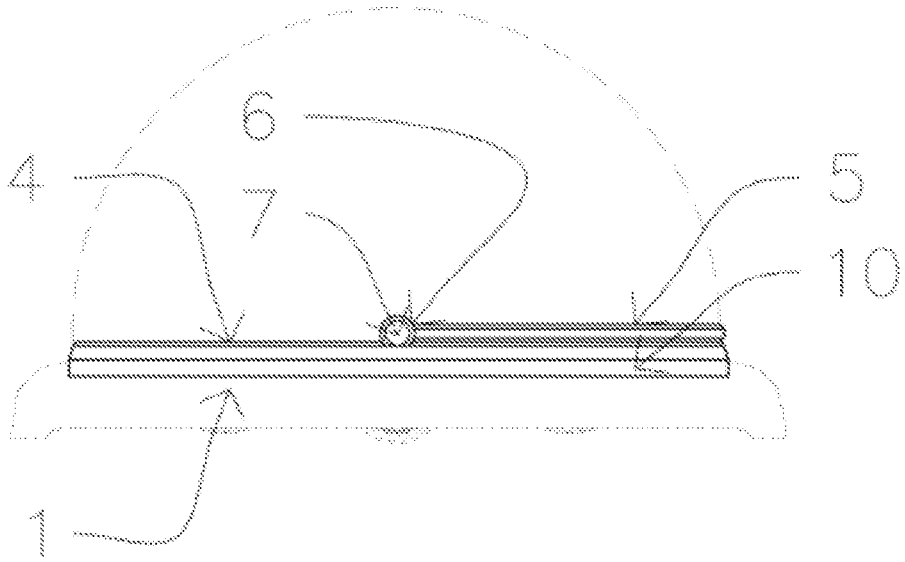
FIG. 10 is a side view of the flip watch bezel of FIG. 1, showing an optional base member for facilitating rotation of the bezel.

The bezel assembly 2 can either be fixedly attached to the watch case 1 or rotatively attached to allow for rotation and adjustment. This feature is illustrated in FIGS. 8 and 9, which show top views of the watch bezel assembly 2. The use positions of FIGS. 8 and 9 are relatively rotated. As shown in FIG. 10, the bezel assembly 2 may optionally include an additional base member 10 that is fixedly coupled to the watch face and rotatively coupled to the lower bezel plate 4. The base member 10 and lower bezel plate 4 may be coupled in a variety of manners, such as a rail extension on one member being captured within a groove provided on the other member.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A bezel assembly for a watch, comprising:

a lower bezel plate, the lower bezel plate having a first surface; and an upper bezel plate rotatably coupled to said lower bezel plate, said upper bezel plate having first and second surfaces; wherein:

said lower bezel plate first surface has first and second sets of indicia thereon;

said upper bezel plate first surface has a set of indicia thereon, said upper bezel plate first surface indicia corresponding to said lower bezel plate first set of indicia;

said upper bezel plate second surface has a set of indicia thereon, said upper bezel plate second surface indicia corresponding to said lower bezel plate second set of indicia; and said upper bezel plate is movable between a first use position in which said lower bezel plate first set of indicia and said upper bezel plate first surface indicia are exposed and said upper bezel plate is positioned atop said lower bezel plate second set of indicia and a second use position in which said lower bezel plate second set of indicia and said upper bezel plate second surface indicia are exposed and said upper bezel plate is positioned atop said lower bezel plate first set of indicia.

2. The bezel assembly of claim 1, wherein:

said lower bezel plate has a first shape, said first shape defining a viewing hole therethrough for allowing visual inspection of the watch, said first shape being substantially symmetric about a first axis; and said upper bezel plate has a second shape that is substantially the same as one-half of said first shape.

3. The bezel assembly of claim 2, wherein said upper bezel plate is coupled to said lower bezel plate at two locations, said two locations being positioned along said axis.

4. The bezel assembly of claim 3, wherein said upper bezel plate is coupled to said lower bezel plate by two hinges, said hinges being positioned on diametric opposite sides of said lower bezel plate.

5. The bezel assembly of claim 4, wherein said upper bezel plate is rotatable about said axis via said hinges.

6. The bezel assembly of claim 1, further comprising a first mechanism to releasably retain said upper bezel plate in said first use position and a second mechanism to releasably retain said upper bezel plate in said second use position.

7. The bezel assembly of claim 6, wherein said first and second mechanisms are detents.

8. The bezel assembly of claim 1, further comprising a mechanism to releasably retain said upper bezel plate in said first use position or said second use position.

9. The bezel assembly of claim 8, wherein said mechanism is a detent.

10. The bezel assembly of claim 1, wherein the bezel assembly is rotatably coupled to the watch.

11. The bezel assembly of claim 1, wherein:

said upper bezel plate first surface indicia and said lower bezel plate first set of indicia cooperatively form a first complete set of indicia;

said upper bezel plate second surface indicia and said lower bezel plate second set of indicia cooperatively form a second complete set of indicia; and said first complete set of indicia is different than said second complete set of indicia.

12. The bezel assembly of claim 1, wherein said upper bezel plate is movable between said first and second use positions by rotation about an axis that is substantially parallel to said first surface.

13. A watch, comprising:

a face;

a lower bezel plate coupled to said face, the lower bezel plate having a first surface; and an upper bezel plate rotatably coupled to said lower bezel plate, said upper bezel plate having first and second surfaces; wherein:

said lower bezel plate first surface has first and second sets of indicia thereon;

said upper bezel plate first surface has a set of indicia thereon, said upper bezel plate first surface indicia corresponding to said lower bezel plate first set of indicia;

said upper bezel plate second surface has a set of indicia thereon, said upper bezel plate to second surface indicia corresponding to said lower bezel plate second set of indicia; and said upper bezel plate is rotatable between a first use position in which said lower bezel plate first set of indicia and said upper bezel plate first surface indicia are visible and said upper bezel plate is positioned atop said lower bezel plate second set of indicia and a second use position in which said lower bezel plate second set of indicia and said upper bezel plate second surface indicia are visible and said upper bezel plate is positioned atop said lower bezel plate first set of indicia.

14. The watch of claim 13, wherein said lower bezel plate is rotatably coupled to said face.

* * * * *